US008312837B2

(12) United States Patent
Madriaga et al.

(10) Patent No.: US 8,312,837 B2
(45) Date of Patent: Nov. 20, 2012

(54) SUPPORT ASSEMBLY FOR STENT COATING

(75) Inventors: Domingo S. Madriaga, San Jose, CA (US); Anh Tran, San Jose, CA (US); Arthur J. Wen, Sunnyvale, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 624 days.

(21) Appl. No.: 12/181,267

(22) Filed: Jul. 28, 2008

(65) Prior Publication Data

US 2008/0276866 A1 Nov. 13, 2008

Related U.S. Application Data

(62) Division of application No. 10/304,669, filed on Nov. 25, 2002, now Pat. No. 7,416,609.

(51) Int. Cl.
*B05C 13/02* (2006.01)
*B05C 5/00* (2006.01)

(52) U.S. Cl. ..... 118/500; 118/320; 118/DIG. 11

(58) Field of Classification Search ..... 118/500, 118/502, 503, 319–320, 307, DIG. 7; 427/2.25, 427/2.24, 2.3; 623/1.46, 1.47, 1.48; 606/108
See application file for complete search history.

(56) References Cited

U.S. PATENT DOCUMENTS 3,683,505 A 8/1972 Graef
4,733,665 A 3/1988 Palmaz
4,800,882 A 1/1989 Gianturco
4,886,062 A 12/1989 Wiktor
4,906,423 A 3/1990 Frisch
4,928,435 A 5/1990 Masaki et al.
5,037,427 A 8/1991 Harada et al.
5,234,457 A 8/1993 Andersen
5,537,729 A 7/1996 Kolobow
5,628,786 A 5/1997 Banas et al.
5,716,981 A 2/1998 Hunter et al.
5,772,864 A 6/1998 Møller et al.
5,788,626 A 8/1998 Thompson
5,895,407 A 4/1999 Jayaraman
5,897,911 A 4/1999 Loeffler
5,922,393 A 7/1999 Jayaraman
5,935,135 A 8/1999 Bramfitt et al.
6,010,573 A * 1/2000 Bowlin ..... 118/620
6,056,993 A 5/2000 Leidner et al.
6,120,847 A 9/2000 Yang et al.
6,126,686 A 10/2000 Badylak et al.
6,153,252 A 11/2000 Hossainy et al.
6,156,373 A * 12/2000 Zhong et al. ..... 427/2.28
6,214,115 B1 4/2001 Taylor et al.
6,258,121 B1 7/2001 Yang et al.
6,322,847 B1 11/2001 Zhong et al.
6,364,903 B2 4/2002 Tseng et al.
6,387,118 B1 5/2002 Hanson
6,517,889 B1 2/2003 Jayaraman (Continued)

OTHER PUBLICATIONS

U.S. Appl. No. 09/254,203, filed Sep. 24, 2002, Kerrigan.

(Continued)

*Primary Examiner* — Yewebdar Tadesse
(74) *Attorney, Agent, or Firm* — Squire Sanders (US) LLP

(57) ABSTRACT

A support assembly for a stent and a method of using the same to coat a stent are provided. The support assembly provides for minimum contact between the stent and the support assembly so as to reduce or eliminate coating defects.

15 Claims, 4 Drawing Sheets

U.S. PATENT DOCUMENTS 6,521,284 B1 2/2003 Parsons et al.
6,527,863 B1 3/2003 Pacetti et al.
6,534,112 B1 * 3/2003 Bouchier et al. ..... 427/2.24
6,544,582 B1 4/2003 Yoe
6,555,157 B1 4/2003 Hossainy
6,565,659 B1 5/2003 Pacetti et al.
6,572,644 B1 6/2003 Moein
6,605,154 B1 8/2003 Villareal
6,673,154 B1 1/2004 Pacetti et al.
6,695,920 B1 2/2004 Pacetti et al.
6,723,373 B1 4/2004 Narayanan et al.
6,818,063 B1 11/2004 Kerrigan
2003/0215564 A1 11/2003 Heller et al.

OTHER PUBLICATIONS

U.S. Appl. No. 10/255,913, filed Sep. 26, 2002, Tang et al.

USPTO, Office Action mailed Nov. 13, 2009 in U.S. Appl. No. 12/193,583 (10 pages).

* cited by examiner

SUPPORT ASSEMBLY FOR STENT COATING

CROSS-REFERENCES TO RELATED APPLICATIONS

This application is a divisional of prior application Ser. No. 10/304,669, filed Nov. 25, 2002, now U.S. Pat. No. 7,416,609 the entire disclosure of which is hereby incorporated by reference.

FIELD OF THE INVENTION

This invention relates to a support assembly for a stent and a method of coating a stent using the assembly.

BACKGROUND OF THE INVENTION

Blood vessel occlusions are commonly treated by mechanically enhancing blood flow in the affected vessels, such as by employing a stent. Stents act as scaffoldings, functioning to physically hold open and, if desired, to expand the wall of the passageway. Typically, stents are capable of being compressed, so that they can be inserted through small lumens via catheters, and then expanded to a larger diameter once they are at the desired location.

FIG. 1 illustrates a conventional stent 10 formed from a plurality of struts 12. The plurality of struts 12 are radially expandable and interconnected by connecting elements 14 that are disposed between adjacent struts 12, leaving lateral openings or gaps 16 between adjacent struts 12. Struts 12 and connecting elements 14 define a tubular stent body having an outer, tissue-contacting surface and an inner surface.

Stents are used not only for mechanical intervention but also as vehicles for providing biological therapy. Biological therapy can be achieved by medicating the stents. Medicated stents provide for the local administration of a therapeutic substance at the diseased site. Local delivery of a therapeutic substance is a preferred method of treatment because the substance is concentrated at a specific site and thus smaller total levels of medication can be administered in comparison to systemic dosages that can produce adverse or even toxic side effects for the patient.

One method of medicating a stent involves the use of a polymeric carrier coated onto the surface of the stent. A composition including a solvent, a polymer dissolved in the solvent, and a therapeutic substance dispersed in the blend is applied to the stent by immersing the stent in the composition or by spraying the composition onto the stent. The solvent is allowed to evaporate, leaving on the stent surfaces a coating of the polymer and the therapeutic substance impregnated in the polymer.

A shortcoming of the above-described method of medicating a stent is the potential for coating defects. While some coating defects can be minimized by adjusting the coating parameters, other defects occur due to the nature of the interface between the stent and the apparatus on which the stent is supported during the coating process. A high degree of surface contact between the stent and the supporting apparatus can provide regions in which the liquid composition can flow, wick, and collect as the composition is applied. If the contact area between the stent and the supporting apparatus is fixed, as the solvent evaporates, the excess composition hardens to form excess coating at and around the contact area. Upon the removal of the coated stent from the supporting apparatus, the excess coating may stick to the apparatus, thereby removing some of the coating from the stent in the form of peels, or leaving bare areas. Alternatively, the excess coating may stick to the stent, thereby leaving excess coating as clumps or pools on the struts or webbing between the struts.

Thus, it is desirable to minimize the fixed interface between the stent and the apparatus supporting the stent during the coating process to minimize coating defects. Accordingly, the present invention provides for a device for supporting a stent during the coating application process. The invention also provides for a method of coating the stent supported by the device.

SUMMARY OF THE INVENTION

In aspects of the present invention, a device for supporting a stent during the application of a coating substance to the stent is provided. The device comprises a first member, a second member, and a third member connecting the first member to the second member. The stent is positioned over the third member during the application of the coating substance to the stent. The outer diameter of the third member is less than the inner diameter of the stent as positioned on the third member and the length of the third member is longer than the length of the stent for allowing the stent to move back and forth between the first member and the second member. In further aspects, a system, the device includes for tilting the third member up and down with respect to a horizontal plane for moving the stent between the first member and the second member. In detailed aspects, the device includes, a pair of gas sources for applying a gas onto the stent at a sufficient pressure for moving the stent between the first member and the second member. In other aspects, the device includes a motor for providing rotational motion to the third member for rotating the stent about the longitudinal axis of the stent. The device in other aspects can also include a pair of sleeves disposed on the third member for allowing the stent to rest thereon. The sleeves prevent the inner surface of the stent from making contact with the outer surface of the third member.

The features and advantages of the invention will be more readily understood from the following detailed description which should be read in conjunction with the accompanying drawings.

DETAILED DESCRIPTION OF THE INVENTION

Figure 1:
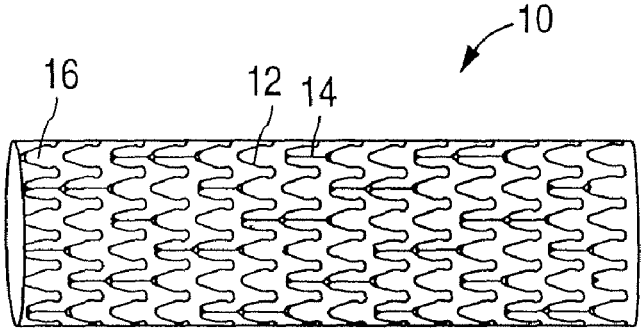
Figure 1 (PRIOR ART)
FIG. 1 illustrates a conventional stent.
Figure 2A:
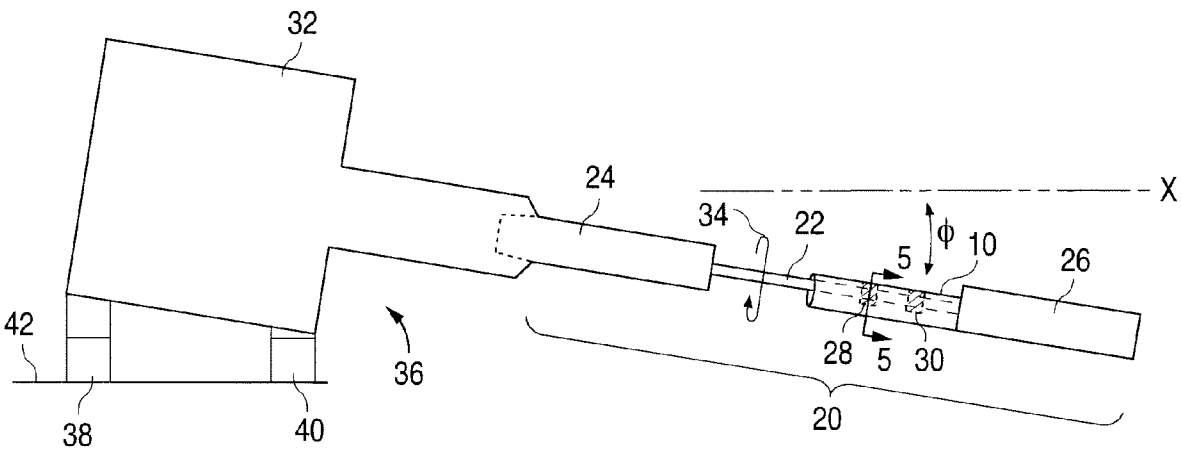
FIGS. 2A-2D illustrate a tilting mechanism for moving a stent during a coating process in accordance with one embodiment of the present invention.
Figure 2B:
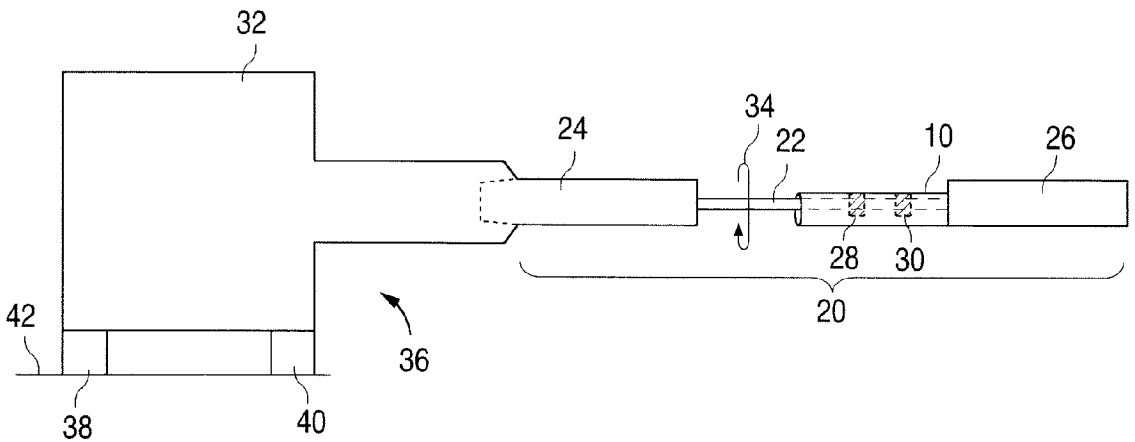
Figure 2C:
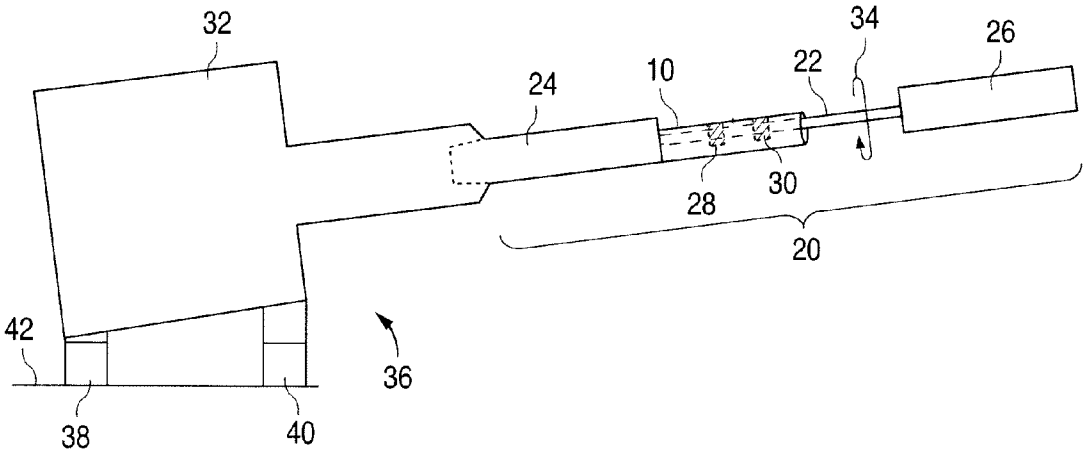
Figure 2D:
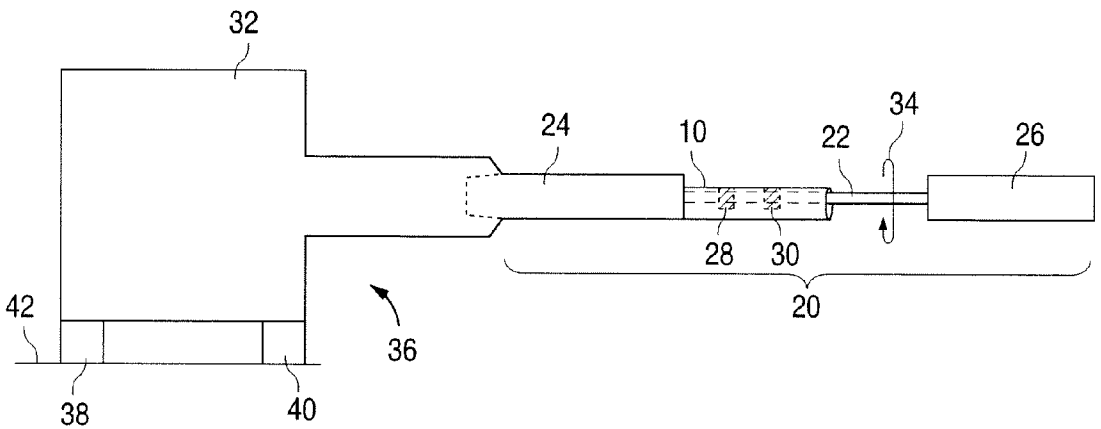

A. System and Device for Coating a Stent

Various types of coating defects can arise due to permanent contact points between a stent and its supporting apparatus. The present invention minimizes or eliminates such coating defects by eliminating permanent contact points between a stent and its supporting apparatus during the coating process.

The type of stent used with the present invention is not of critical significance and the term stent is broadly intended to include stent-grafts and radially expandable stents, such as balloon-expandable stents or self-expandable type.

Referring to FIGS. 2A-2D, a mounting assembly 20 for supporting a stent 10 during a coating process is illustrated to include a middle arm or mandrel 22 connected to end stops 24 and 26. At least one of end stops 24 or 26 should be disengageable from mandrel 22 so as to allow stent 10 to be placed over mandrel 22. The length of mandrel 22 should be longer than the length of stent 10 used such that stent 10 can move back and forth between end stops 24 and 26. At least one of end stops 24 or 26 can be adjustably coupled to mandrel 22 so as to allow the length of mandrel 22 to be appropriately adjusted to accommodate stents of various lengths. The diameter of mandrel 22 should be less than the inner diameter of stent 10 as positioned on assembly 20 to minimize contact between the outer surface of mandrel 22 and the inner surface of stent 10. To further minimize such contact, sleeves 28 and 30 can be positioned on mandrel 22. Sleeves 28 and 30 can be small cylindrical protrusions having a diameter slightly larger than the diameter of mandrel 22. Sleeves 28 and 30 can be used not only to minimize the contact between stent 10 and assembly 20, but also can be used to rotate stent 10 about the longitudinal axis of stent 10. The diameter of sleeves 28 and 30 should also be smaller than the inner diameter of stent 10 as positioned on assembly 20. End stops 24 and 26 should be sized so as to prevent stent 10 from gliding off mandrel 22 during the coating process.

Mandrel 22 can be connected to a motor 32 so as to provide rotational motion as depicted by arrow 34 about the longitudinal axis of stent 10 during the coating process. In addition, the present invention can include a means for moving stent 10 back and forth between end stops 24 and 26. In one embodiment, mandrel 22 can be tilted, back and forth, in an angular direction Φ relative to the horizontal plane X by use of a pivoting system 36. Pivoting system 36 can include, for example, motor 32 and a first pneumatic cylinder 38 and a second pneumatic cylinder 40 that are mounted on a platform 42. Cylinders 38 and 40 can be independently actuated by air supplied through a solenoid valve to raise and lower the ends of motor 32 as illustrated in FIGS. 2A-2D.

Figure 3:
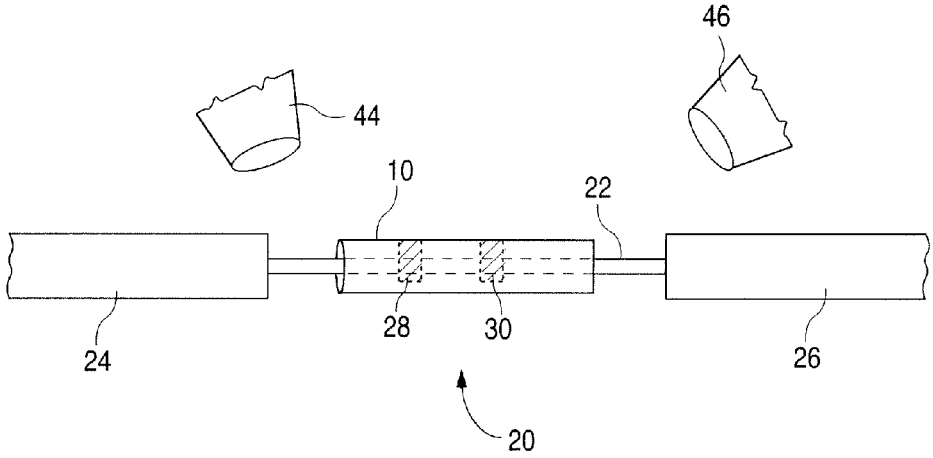
FIG. 3 illustrate a system for moving a stent during a coating process in accordance with one embodiment of the present invention.

Referring to FIG. 3, in another embodiment, air can be directed at stent 10 in order to move stent 10 back and forth between end stops 24 and 26. Mandrel 22 does not tilt in this embodiment, as it remains in a generally horizontal position during the application of the coating. Gas sources 44 and 46 can provide a stream of gas of sufficient force to move stent 10 between end stops. For example, gas sources 44 and 46 can be positioned about 1 inch (25.4 mm) to about 2 inches (50.8 mm) from stent 10. Gas sources 44 and 46 can include air nozzles and solenoid valves to control the air flow to each nozzle. Nozzles having diameters of about 0.06 inches (1.52 mm) to about 0.12 inches (3.05 mm) can be used. The nozzles can be oriented at a suitable angle with respect to stent 10 so as to minimize interference with the coating composition applied on stent 10 while effectively maintaining the movement of stent 10 on mandrel 22. For example, gas sources 44 and 46 can be oriented at about a 15° to about a 45° angle relative to the longitudinal axis of stent 10. Any suitable gas can be delivered by gas sources 44 and 46, examples of which include air, argon or nitrogen.

A variety of sizes and shapes for sleeves 28 and 30 can be contemplated so as to provide adequate support for stent 10 without being in too much contact with the inner surface of stent 10 so as to cause coating defects. Sleeves 28 and 30 should be able to provide enough contact area and engagement with the inner surface of stent 10 to rotate stent 10 during the coating process. Accordingly, there is a tradeoff with, on the one hand, minimizing the contact area between the outer surface of sleeves 28 and 30 and the inner surface of stent 10, and on the other hand, for allowing sleeves 28 and 30 to adequately rotate stent 10.

Providing sleeves 28 and 30 of small diameters, as compared to the inner diameter of stent 10, offsets the axis about which sleeves 28 and 30 rotate, away from the axis about which stent 10 rotates (i.e., the axis positioned longitudinally through the center of stent 10). Also, it is important that there is sufficient clearance between the outer surface of mandrel 22 and the inner surface of stent 10 to prevent mandrel 22 from obstructing the pattern of the stent body during the coating process. By way of example, stent 10 can have an inner diameter of about 0.059 inches (1.50 mm) to about 0.320 inches (8.13 mm), the outer diameter of mandrel 22 can be from about 0.010 inches (0.254 mm) to about 0.088 inches (2.235 mm), and the outer diameter of sleeves 28 and 30 can be from about 0.032 inches (0.813 mm) to about 0.2 inches (5.08 mm). The length of sleeves 28 and 30 will typically be significantly less than the length of mandrel 22. By way of example, the length of sleeves 28 and 30 will be about 0.01 inches (0.254 mm) to about 0.1 inches (2.54 mm), while the length of the mandrel 22 will be about 1 inch (25.4 mm) to about 6 inches (152.40 mm). Exemplary specifications that can be employed with stent 10 having a length of about 18 mm and an inner diameter of about 1.8 mm include:

| COMPONENT | LENGTH (mm) | DIAMETER (mm) |
|---|---|---|
| Mandrel | 50 | 0.56 |
| Sleeves | 0.51 | 1.22 |

Figure 4A:
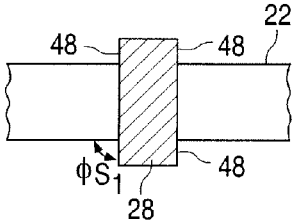
FIGS. 4A-4C are enlarged side views of a portion of the support assembly in accordance with one aspect of the present invention.
Figure 4B:
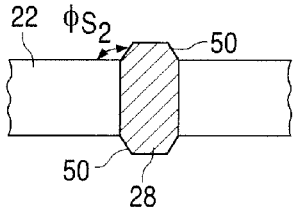
Figure 4C:
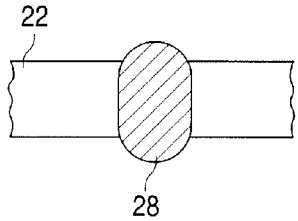

Furthermore, sleeves 28 and 30 can have a variety of shapes. Representative examples include rectangular-, triangular-, octagonal-, or gear-shaped, having protruding teeth for engagement with stent 10. These shapes can further minimize contact between sleeves 28 and 30 and the inner surface of stent 10 while allowing for a forceful engagement between stent 10 and sleeves 28 and 30. In an alternative embodiment, sleeves 28 and 30 can be substantially circular. FIGS. 4A-4C illustrate some exemplary geometrical configurations for sleeve 28. FIG. 4A, for instance, illustrates a circular outer circumference with parallel sides 48. FIG. 4B illustrates beveled sides 50 of sleeve 28. Sides 48 and 50 can taper off at any suitable angle $\Phi_{s1}$ and $\Phi_{s2}$. In one embodiment, $\Phi_{s1}$ and $\Phi_{s2}$ can be between 90° and 120°. In yet another variation, as illustrated in FIG. 4C, the outer surface of sleeve 28 can be curved or have a radius of curvature.

Sleeves 28 and 30 can be fixed (e.g., by soldering or using an adhesive), or adjustably attached to mandrel 22 (e.g., by threading the sleeves over the mandrel). However, sleeves 28 and 30 should be firmly secured to mandrel 22 during the coating process in order to ensure that sleeves 28 and 30 rotate with mandrel 22. Mandrel 22 and sleeves 28 and 30 can be made of stainless steel, polyetheretherketone (PEEK), polytetrafluoroethylene (PTFE) (TEFLON™), DELRIN™, RULON™, PEBAX™, NYLON™ and fluorinated ethylene-propylene copolymer (FEP).

B. Method of Coating a Stent Using the Mounting Device

Referring to FIGS. 2A-2D, during the application of the coating substance, stent 10 is supported by sleeves 28 and 30 on mandrel 22. While the coating substance is applied to stent 10, mandrel 22 can be rotated about the longitudinal axis of stent 10. Rotation of stent 10 can be from about 1 rpm to about 300 rpm, more narrowly from about 50 rpm to about 150 rpm. By way of example, stent 10 can rotate at about 120 rpm.

Figure 5A:
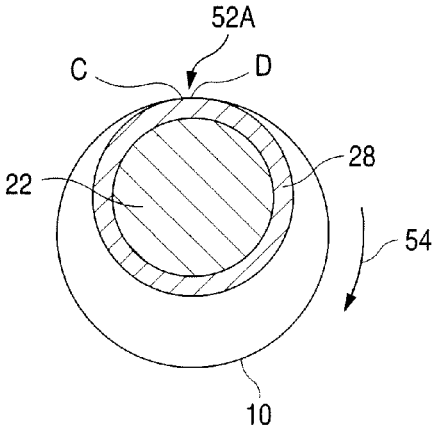
FIGS. 5A and 5B are cross-sectional views along the line 5-5 in FIG. 2A that illustrates the interface between a portion of the support assembly and a stent.
Figure 5B:
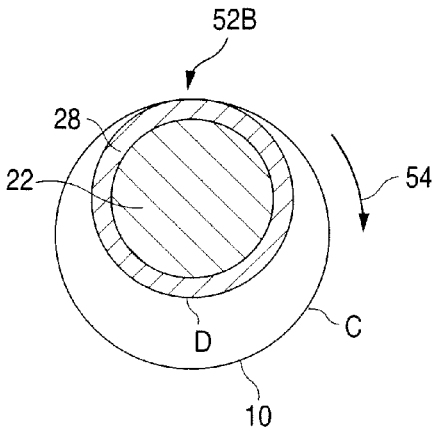

Referring to FIG. 5A, a contact area 52A between the inner surface of stent 10 and the outer surface of sleeve 28 can be formed while sleeve 28 and stent 10 are being rotated in the direction of arrow 54. As sleeve 28 and stent 10 are rotated, however, the surfaces of sleeve 28 and stent 10 have relatively different rotational speeds because they have different diameters, and therefore the contact area moves to a new position. For example, as shown in FIG. 5A, locus C of the inner surface of stent 10 and locus D of the outer surface of sleeve 28 are in contact area 52A. Nevertheless, as sleeve 28 and stent 10 are rotated, a new contact area 52B is formed (FIG. 5B). As the coating is applied to stent 10, by changing the position of contact area 52 relative to the inner surface of stent 10 and the outer surface of sleeve 28 as shown in FIGS. 5A and 5B, the potential for coating defects is decreased because the fixed interface between stent 10 and sleeve 28 is eliminated thereby preventing a concentration of the coating substance in any one particular area.

Stent 10 can be moved between end stops 24 and 26 in order to provide for the movement of the contact area between stent 10 and sleeves 28 and 30 in a linear direction along the axis of stent 10. Stent 10 can be moved as the composition is being applied. Alternatively, when the coating is applied in multiple repetitions, stent 10 can be moved in between each repetition. In other words, stent 10 can be moved while the spray coater is inactive, for example, during an intermediate drying step.

In one embodiment, tilting mandrel 22 up and down can move stent 10 between end stops 24 and 26. Referring back to FIGS. 2A-2D, cylinders 38 and 40 are actuated thereby tilting mandrel 22 at an angle of, for example +/−30°. Tilting in combination with rotation of stent 10 provides moving points of contact between stent 10 and sleeves 28 and 30 during the coating process.

In another embodiment, stent 10 can be moved back and forth between end stops 24 and 26 by directing a gas to stent 10 during the coating process. Referring to FIG. 3, gas sources 44 and 46 can provide a stream of gas of sufficient force to move stent 10 between end stops 24 and 26. Gas sources 44 and 46 can alternate application of gas for moving stent 10 back and forth. By way of example, the pressure of gas sources 44 and 46 can be about 60 psi to about 120 psi. Typically, the gas pressure directed to stent 10 should be sufficient to move stent 10 along the length of mandrel 22 in a constant, gentle manner, and should not be so high as to cause coating defects during the coating process.

The following method of application is being provided by way of illustration and is not intended to limit the embodiments of the present invention. A spray apparatus, such as EFD 780S spray device with VALVEMATE 7040 control system (manufactured by EFD Inc., East Providence, R.I.), can be used to apply a composition to a stent. EFD 780S spray device is an air-assisted external mixing atomizer. The composition is atomized into small droplets by air and uniformly applied to the stent surfaces. The atomization pressure can be maintained at a range of about 5 psi to about 20 psi. The droplet size depends on such factors as viscosity of the solution, surface tension of the solvent, and atomization pressure. Other types of spray applicators, including air-assisted internal mixing atomizers and ultrasonic applicators, can also be used for the application of the composition.

The flow rate of the solution from the spray nozzle can be from about 0.01 mg/second to about 1.0 mg/second, more narrowly about 0.1 mg/second. Multiple repetitions for applying the composition can be performed, wherein each repetition can be, for example, about 1 second to about 10 seconds in duration. The amount of coating applied by each repetition can be about 0.1 micrograms/cm$^2$ (of stent surface) to about 10 micrograms/cm$^2$, for example less than about 2 micrograms/cm$^2$ per 5-second spray. As described above, stent 10 can be moved as the composition is being applied. Alternatively, when the coating is applied in multiple repetitions, the stent can be moved in between the repetitions. It may be advantageous to move the stent after the composition has been applied so that the movement does not interfere with the uniformity of the spray coating.

Each repetition can be followed by removal of a significant amount of the solvent(s). Depending on the volatility of the particular solvent employed, the solvent can evaporate essentially upon contact with the stent. Alternatively, removal of the solvent can be induced by baking the stent in an oven at a mild temperature (e.g., 60° C.) for a suitable duration of time (e.g., 2-4 hours) or by the application of warm air. The application of warm air between each repetition prevents coating defects and minimizes interaction between the active agent and the solvent. The warm air applied to the stent to induce evaporation can also be used to move the stent to cause movement of the contact area in a linear direction along the axis of the stent. The temperature of the warm air can be from about 30° C. to about 60° C., more narrowly from about 40° C. to about 50° C. The flow rate of the warm air can be from about 20 cubic feet/minute (CFM) (0.57 cubic meters/minute (CMM)) to about 80 CFM (2.27 CMM), more narrowly about 30 CFM (0.85 CMM) to about 40 CFM (1.13 CMM). The warm air can be applied for about 3 seconds to about 60 seconds, more narrowly for about 10 seconds to about 20 seconds. By way of example, warm air applications can be performed at a temperature of about 50° C., at a flow rate of about 40 CFM, and for about 10 seconds. Any suitable number of repetitions of applying the composition followed by removing the solvent(s) can be performed to form a coating of a desired thickness or weight. Excessive application of the polymer in a single application can, however, cause coating defects.

Operations such as wiping, centrifugation, or other web clearing acts can also be performed to achieve a more uniform coating. Briefly, wiping refers to the physical removal of excess coating from the surface of the stent; and centrifugation refers to rapid rotation of the stent about an axis of rotation. The excess coating can also be vacuumed off of the surface of the stent.

The stent can be at least partially preexpanded prior to the application of the composition. For example, the stent can be radially expanded about 20% to about 60%, more narrowly about 27% to about 55%—the measurement being taken from the stent's inner diameter at an expanded position as compared to the inner diameter at the unexpanded position. The expansion of the stent, for increasing the interspace between the stent struts during the application of the composition, can further prevent "cob web" formation between the stent struts.

The coating substance can include a solvent and a polymer dissolved in the solvent and optionally a wetting fluid. The coating substance can also include an active agent. Representative examples of polymers that can be used to coat a stent in accordance with the present invention include ethylene vinyl alcohol copolymer (commonly known by the generic name EVOH or by the trade name EVAL), poly(hydroxyvalerate); poly(L-lactic acid); polycaprolactone; poly(lactide-co-glycolide); poly(hydroxybutyrate); poly(hydroxybutyrate-co-valerate); polydioxanone; polyorthoester; polyanhydride; poly(glycolic acid); poly(D,L-lactic acid); poly(glycolic acid-co-trimethylene carbonate); polyphosphoester; polyphosphoester urethane; poly(amino acids); cyanoacrylates; poly(trimethylene carbonate); poly(iminocarbonate); copoly (ether-esters) (e.g. PEO/PLA); polyalkylene oxalates; polyphosphazenes; biomolecules, such as fibrin, fibrinogen, cellulose, starch, collagen and hyaluronic acid; polyurethanes; silicones; polyesters; polyolefins; polyisobutylene and ethylene-alphaolefin copolymers; acrylic polymers and copolymers; vinyl halide polymers and copolymers, such as polyvinyl chloride; polyvinyl ethers, such as polyvinyl methyl ether; polyvinylidene halides, such as polyvinylidene fluoride and polyvinylidene chloride; polyacrylonitrile; polyvinyl ketones; polyvinyl aromatics, such as polystyrene; polyvinyl esters, such as polyvinyl acetate; copolymers of vinyl monomers with each other and olefins, such as ethylene-methyl methacrylate copolymers, acrylonitrile-styrene copolymers, ABS resins, and ethylene-vinyl acetate copolymers; polyamides, such as Nylon 66 and polycaprolactam; alkyd resins; polycarbonates; polyoxymethylenes; polyimides; polyethers; epoxy resins; polyurethanes; polybutylmethacrylate; rayon; rayon-triacetate; cellulose acetate; cellulose butyrate; cellulose acetate butyrate; cellophane; cellulose nitrate; cellulose propionate; cellulose ethers; and carboxymethyl cellulose.

"Solvent" is defined as a liquid substance or composition that is compatible with the polymer and is capable of dissolving the polymer at the concentration desired in the composition. Examples of solvents include, but are not limited to, dimethylsulfoxide, chloroform, acetone, water (buffered saline), xylene, methanol, ethanol, 1-propanol, tetrahydrofuran, 1-butanone, dimethylformamide, dimethylacetamide, cyclohexanone, ethyl acetate, methylethylketone, propylene glycol monomethylether, isopropanol, isopropanol admixed with water, N-methyl pyrrolidinone, toluene, and combinations thereof.

A "wetting" of a fluid is measured by the fluid's capillary permeation. Capillary permeation is the movement of a fluid on a solid substrate driven by interfacial energetics. Capillary permeation is quantitated by a contact angle, defined as an angle at the tangent of a droplet in a fluid phase that has taken an equilibrium shape on a solid surface. A low contact angle means a higher wetting liquid. A suitably high capillary permeation corresponds to a contact angle less than about 90°. Representative examples of the wetting fluid include, but are not limited to, tetrahydrofuran, dimethylformamide, 1-butanol, n-butyl acetate, dimethylacetamide, and mixtures and combinations thereof.

The active agent contained in the coating can be for inhibiting the activity of vascular smooth muscle cells. More specifically, the active agent can be aimed at inhibiting abnormal or inappropriate migration and/or proliferation of smooth muscle cells for the inhibition of restenosis. The active agent can also include any substance capable of exerting a therapeutic or prophylactic effect in the practice of the present invention. For example, the active agent can be for enhancing wound healing in a vascular site or improving the structural and elastic properties of the vascular site. Examples of active agents include antiproliferative substances such as actinomycin D, or derivatives and analogs thereof (manufactured by Sigma-Aldrich 1001 West Saint Paul Avenue, Milwaukee, Wis. 53233; or COSMEGEN available from Merck). Synonyms of actinomycin D include dactinomycin, actinomycin IV, actinomycin $I_1$, actinomycin $X_1$, and actinomycin $C_1$. The active agent can also fall under the genus of antineoplastic, antiinflammatory, antiplatelet, anticoagulant, antifibrin, antithrombin, antimitotic, antibiotic, antiallergic and antioxidant substances. Examples of such antineoplastics and/or antimitotics include paclitaxel (e.g. TAXOL® by Bristol-Myers Squibb Co., Stamford, Conn.), docetaxel (e.g. TAXOTERE®, from Aventis S.A., Frankfurt, Germany), methotrexate, azathioprine, vincristine, vinblastine, fluorouracil, doxorubicin hydrochloride (e.g. ADRIAMYCIN® from Pharmacia & Upjohn, Peapack, N.J.), and mitomycin (e.g. MUTAMYCIN® from Bristol-Myers Squibb Co., Stamford, Conn.) Examples of such antiplatelets, anticoagulants, antifibrin, and antithrombins include sodium heparin, low molecular weight heparins, heparinoids, hirudin, argatroban, forskolin, vapiprost, prostacyclin and prostacyclin analogues, dextran, D-phe-pro-arg-chloromethylketone (synthetic antithrombin), dipyridamole, glycoprotein IIb/IIIa platelet membrane receptor antagonist antibody, recombinant hirudin, and thrombin inhibitors such as ANGIOMAX™ (Biogen, Inc., Cambridge, Mass.) Examples of such cytostatic or antiproliferative agents include angiopeptin, angiotensin converting enzyme inhibitors such as captopril (e.g. CAPOTEN® and CAPOZIDE® from Bristol-Myers Squibb Co., Stamford, Conn.), cilazapril or lisinopril (e.g. PRINIVIL® and PRINZIDE® from Merck & Co., Inc., Whitehouse Station, N.J.), calcium channel blockers (such as nifedipine), colchicine, fibroblast growth factor (FGF) antagonists, fish oil (omega 3-fatty acid), histamine antagonists, lovastatin (an inhibitor of HMG-CoA reductase, a cholesterol lowering drug, brand name MEVACOR® from Merck & Co., Inc., Whitehouse Station, N.J.), monoclonal antibodies (such as those specific for Platelet-Derived Growth Factor (PDGF) receptors), nitroprusside, phosphodiesterase inhibitors, prostaglandin inhibitors, suramin, serotonin blockers, steroids, thioprotease inhibitors, triazolopyrimidine (a PDGF antagonist), and nitric oxide. An example of an antiallergic agent is permirolast potassium. Other therapeutic substances or agents which may be appropriate include alpha-interferon, genetically engineered epithelial cells, tacrolimus, dexamethasone, and rapamycin and structural derivatives or functional analogs thereof, such as 40-O-(2-hydroxy)ethyl-rapamycin (known by the trade name of EVEROLIMUS available from Novartis), 40-O-(3-hydroxy)propyl-rapamycin, 40-O-[2-(2-hydroxy)ethoxy]ethyl-rapamycin, and 40-O-tetrazole-rapamycin.

While particular embodiments of the present invention have been shown and described, it will be apparent to those skilled in the art that changes and modifications can be made without departing from the scope of the invention. Therefore, the appended claims are to encompass within their scope all such changes and modifications as fall within the true spirit and scope of this invention.

What is claimed is:

1. A device for supporting a stent during the application of a coating substance to the stent, comprising:

a first member;

a second member; and a third member connecting the first member to the second member, wherein when the stent is positioned over the third member during the application of the coating substance to the stent, an outer diameter of the third member is less than an inner diameter of the stent as positioned on the third member and the third member is longer than the stent for allowing the stent to move back and forth between the first member and the second member; and a pivoting mechanism configured to tilt the third member up and down with respect to a horizontal plane.

2. The device of claim 1 wherein the first member and the second member are connected to opposite ends of the third member.

3. The device of claim 1, further comprising a motor for providing rotational motion to the third member for rotating the stent about the longitudinal axis of the stent.

4. The device of claim 1, further comprising a pair of sleeves disposed on the third member for allowing an inner surface of the stent to rest thereon, wherein when the stent rests of the pair of sleeves, the pair of sleeves prevents the inner surface of the stent from making contact with an outer surface of the third member.

5. The device of claim 1, wherein a majority of the entire inner surface of the stent does not make contact with any portion of the entire outer surface of the third member.

6. The device of claim 1, wherein the pivoting mechanism comprises a pneumatic cylinder.

7. A device for supporting a stent during the application of a coating substance to the stent, comprising:

a first member;

a second member; and a third member connecting the first member to the second member, wherein when the stent is positioned over the third member during the application of the coating substance to the stent, an outer diameter of the third member is less than an inner diameter of the stent as positioned on the third member and the third member is longer than the stent for allowing the stent to move back and forth between the first member and the second member; and a pair of gas sources oriented relative to the stent and configured to apply a gas onto the stent at a sufficient pressure to move the stent between the first member and the second member.

8. The device of claim 7, wherein each of the pair of gas sources has a gas outlet, the gas outlets disposed at a distance from the third member and located between the first member and the second member.

9. The device of claim 7, wherein the pair of gas sources are configured to alternate application of gas to move the stent between the first member and the second member.

10. A device for supporting a stent during the application of a coating substance to the stent, comprising:

a first member;

a second member;

a third member connecting the first member to the second member, wherein when the stent is positioned over the third member during the application of the coating substance to the stent, an outer diameter of the third member is less than an inner diameter of the stent as positioned on the third member and the third member is longer than the stent for allowing the stent to move back and forth between the first member and the second member; and a pair of sleeves disposed on the third member for allowing the inner surface of the stent to rest thereon, the pair of sleeves preventing the inner surface of the stent from making contact with an outer surface of the third member, wherein the pair of sleeves are configured to move relative to the third member and move back and forth between the first member and the second member.

11. The device of claim 10, further comprising a means for moving the stent back and forth between the first member and the second member.

12. The device of claim 10, further comprising a means for rotating the third member.

13. A device for supporting a stent during the application of a coating substance to the stent, comprising:

a first member;

a second member;

a third member connecting the first member to the second member, wherein when the stent is positioned over the third member during the application of the coating substance to the stent, an outer diameter of the third member is less than an inner diameter of the stent as positioned on the third member and the third member is longer than the stent for allowing the stent to move back and forth between the first member and the second member; and a pair of sleeves disposed on the third member for allowing the inner surface of the stent to rest thereon, the pair of sleeves preventing the inner surface of the stent from making contact with an outer surface of the third member, wherein the pair of sleeves are rotatably engaged with the third member so that the pair of sleeves rotate when the third member is rotated about the longitudinal axis of the third member.

14. The device of claim 13, further comprising a means for moving the stent back and forth between the first member and the second member.

15. The device of claim 13, further comprising a means for rotating the third member.

* * * * *

UNITED STATES PATENT AND TRADEMARK OFFICE

CERTIFICATE OF CORRECTION

PATENT NO. : 8,312,837 B2
APPLICATION NO. : 12/181267
DATED : November 20, 2012
INVENTOR(S) : Madriaga et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 734 days.

Signed and Sealed this
Eleventh Day of November, 2014

Michelle K. Lee

Michelle K. Lee
*Deputy Director of the United States Patent and Trademark Office*